United States Patent [19]

Henry

[11] Patent Number: 4,592,813

[45] Date of Patent: Jun. 3, 1986

[54] FULL POT ANODE CHANGE IN THE PRODUCTION OF ALUMINUM

[75] Inventor: George H. Henry, Newburgh, Ind.

[73] Assignee: Aluminum Company of America, Pittsburgh, Pa.

[21] Appl. No.: 723,830

[22] Filed: Apr. 16, 1985

[51] Int. Cl.[4] ..... C25C 3/06

[52] U.S. Cl. ..... 204/67; 204/245; 204/247

[58] Field of Search ..... 204/67, 245, 246, 247

[56] References Cited

U.S. PATENT DOCUMENTS 3,491,002 1/1970 Dewey ..... 204/67

*Primary Examiner*—Edward S. Williams

*Attorney, Agent, or Firm*—Daniel A. Sullivan, Jr.

[57] ABSTRACT

In a process for producing aluminum by electrolysis of alumina dissolved in a cryolite-based molten salt contained between a cathode and a plurality of previously baked carbon anodes which are consumed with evolution of oxides of carbon, the improvement including setting all anodes at the same time.

9 Claims, 3 Drawing Figures

FULL POT ANODE CHANGE IN THE PRODUCTION OF ALUMINUM

BACKGROUND OF THE INVENTION

FIG. 1 shows a prior art Hall/Heroult cell for producing aluminum metal accumulating in molten pad 10 by electrolysis of alumina dissolved in a cryolite-based molten salt, bath 12, between a carbon cathode 14 and previously baked carbon anodes 16*a*, 16*b*. The carbon anodes are consumed with evolution of oxides of carbon, leaving butts such as in 16*a*.

The anodes include steel stubs 18 and copper or aluminum rods 20 clamped to a bridge 22 which can move up and down on a superstructure 23 to maintain or vary the distance between the bottom anode surfaces 24*a*, 24*b* and the molten metal pad 10.

SUMMARY OF THE INVENTION

It is an object of the invention to provide an improved way of operating Hall/Heroult cells for producing aluminum.

This as well as other objects which will become apparent from the discussion that follows are achieved, according to the present invention, by providing, in a process for producing aluminum by electrolysis of alumina dissolved in a cryolite-based molten salt contained between a cathode and a plurality of previously baked carbon anodes which are consumed with evolution of oxides of carbon, the improvement comprising setting all anodes at the same time.

DETAILED DESCRIPTION OF THE PREFERRED EMBODIMENTS

Figure 1:
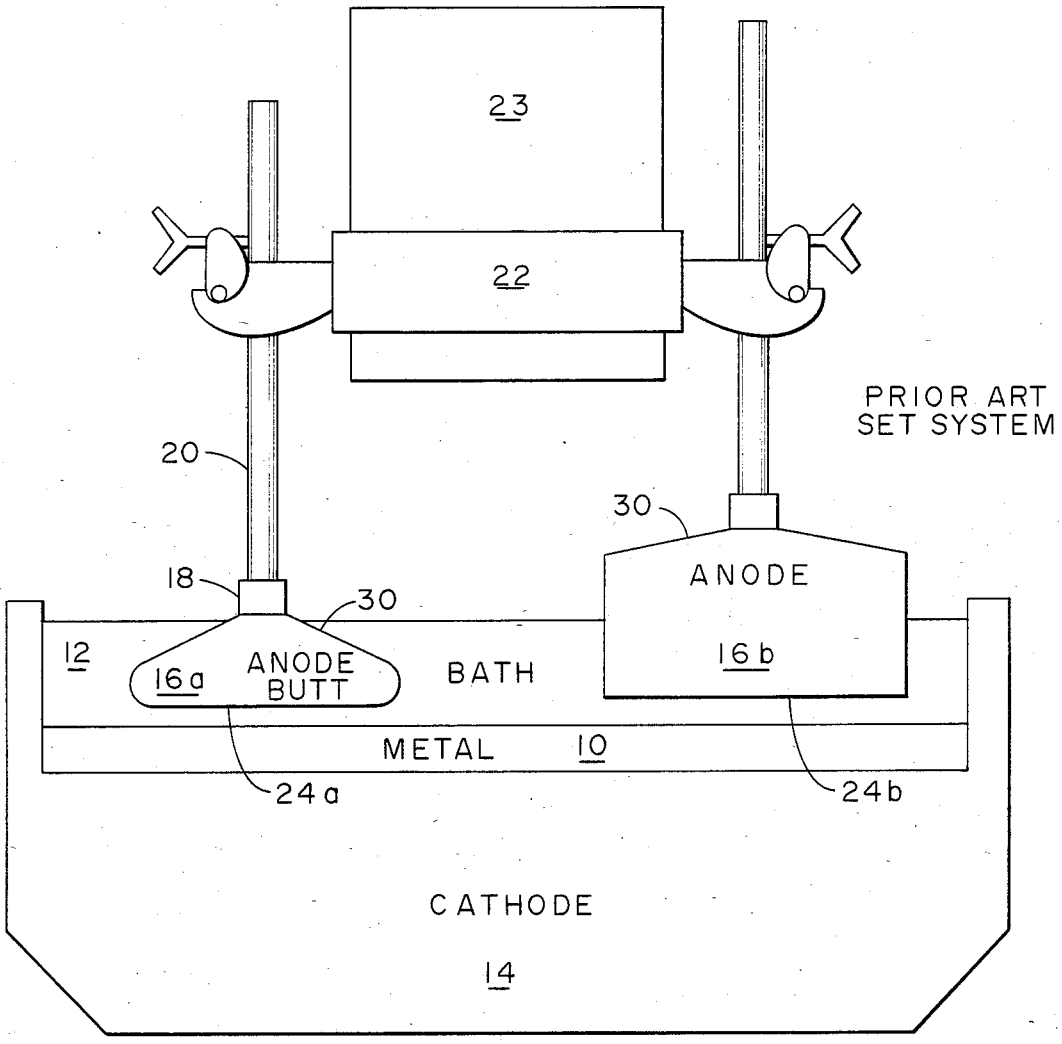
FIGS. 1 to 3 are schematic elevational end views of Hall/Heroult cells.

Carbon is consumed in Hall/Heroult cells in three ways. One is the production of aluminum, i.e. $Al_2O_3+C \rightarrow Al+CO_2\uparrow$. Another is airburning of carbon that serves no other purpose than to wastefully consume carbon i.e. $C+O_2 \rightarrow CO+CO_2$. A third is carbon dusting, where carbon particles detach from an anode and enter the bath. The amount of carbon consumed can be calculated stoichiometrically from the amount of aluminum produced which is based on electrical current level (amps) and current efficiency. Current efficiency changes are relatively small (1%–2%) when compared to the 5% change in carbon cycle life that results from adding or subtracting a day of set life. In addition, the amount of airburning does not change greatly and is, therefore, predictable. Consequently, knowing the weight of anode, the production of aluminum, and the amount of airburning we can establish anode cycle life. In practice, we approach this from the conservative position and then lengthen the cycle life, based on experience, by actually measuring butt height to consume the carbon most efficiently without other detrimental effects—primarily bath attack of the steel stub that results in damage to the stub and a decrease in metal purity.

Carbon anodes are regularly set in a Hall/Heroult cell, or pot, as the carbon gets consumed to a point where attack of the stub becomes possible. Normally, between 4% and 25% of the anodes are set per day. No one has ever attempted to set all the anodes in a pot at the same time, because of suspected problems associated including maintenance of pot control and suspected overloading of old carbon (butts) that would then separate from the stub assembly. The degree of these disturbances does increase as more new anodes are clamped in place in the full pot set of the invention until all new carbon is set, but then the problems disappear due to the resulting uniform anode resistance presented by having all anodes of essentially the same newness.

The procedure for setting all anodes at the same time includes removing spent anodes, called butts, and replacing them with new anodes within preferably an hour. This process is called setting. While I say "same time", it must be recognized that there will always be some finite time involved. I prefer to accomplish the job from start to finish as quickly as possible, e.g. within an hour, in order to have the conditions at each anode position the same as quickly as possible. However, spreading the setting over 24, or even 48, hours will still give some of the benefits, although perhaps at the expense of a little higher voltage. Consequently, I am using "same time" as a relative term indicating a faster rate of setting than the 4 to 25% anode set rate previously used.

Prior to setting, the pot has the crust broken into the pot, and additional heat, provided by increased pot voltage, is used to dissolve and melt the respective crust constituents. Setting begins by removing one, two or three butts and replacing them with new anodes. The process is repeated until all new anodes are set in the pot. Completion of this task is usually about one hour. During setting, the butts draw more current due to their lower resistance until the pot voltage increases from anode effect. Anode effect occurs on the butts, increasing their effective resistance and preventing further overloading. The magnitude and existence of the anode effect can be controlled by anode bridge movement.

An anode effect occurs when surface tension changes in the $CO_2$ gas formed to cause this gas to form a layer or film on the bottom of the anodes. Three factors are influential in causing an anode effect. They are: (1) concentration of alumina dissolved in the bath, (2) the bath temperature, and (3) the current density. The latter two items increase the likelihood of an anode effect when carrying out the invention. The cooling effect of the new anodes reduces the bath temperature, and the current density increases on butts still not changed, because they have less electrical resistance than the new anodes. Resistance of new anodes is higher because they are taller and colder than the old anode butts. Cold carbon is less conductive than hot carbon. However, and this is believed to be the main reason for the greater resistance of new anodes, the cold material causes bath to freeze as a non-conductive coating on new anodes.

In normal operation, the metal in the pot is turbulent. This turbulence increases when the pot goes on anode effect. By lowering the anodes closer to the metal or, in some cases, into the metal, the gas layer can be "washed" from the bottom of the anodes and/or the anodes shorted to the metal pad. By doing this, the anode effect can be kept low enough to minimize the hazards from high voltage.

Figure 2:
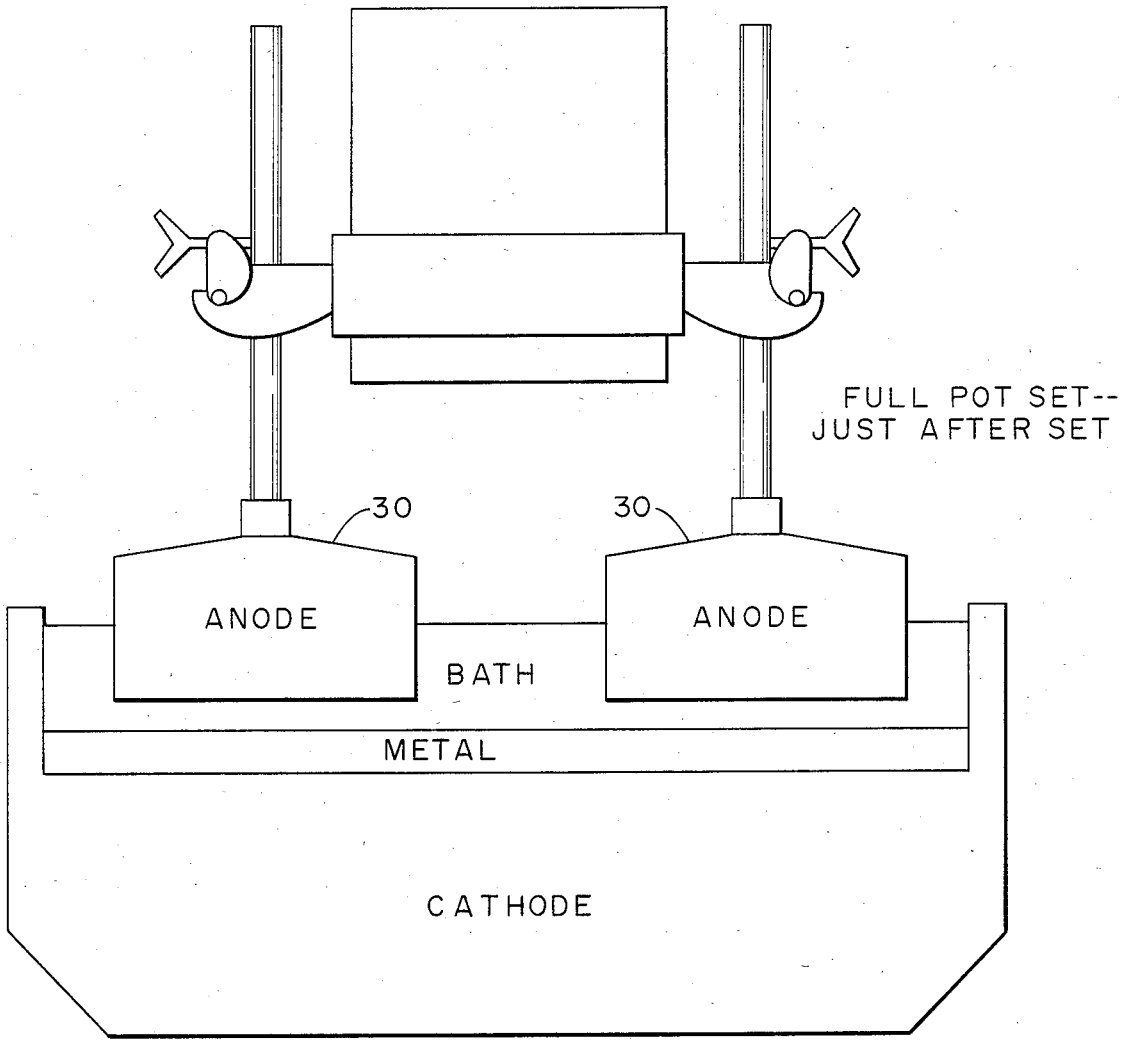
Figure 3:
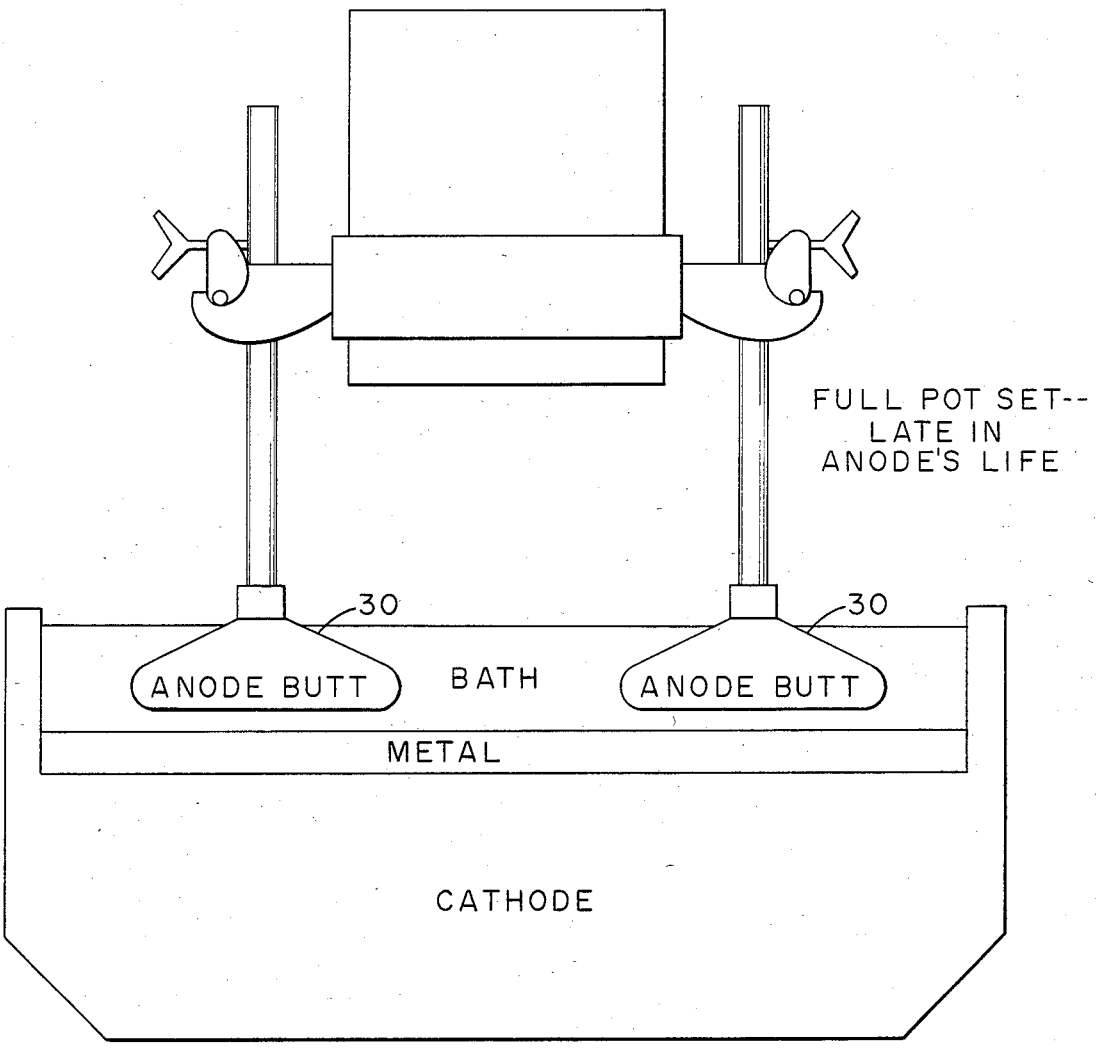

FIG. 2 shows the appearance of a cell just after all the anodes have been set according to the invention, while FIG. 3 shows a cell per the invention late in the anode life.

Note in FIGS. 2 and 3 compared with FIG. 1 that the upper surfaces 30 of the carbons are at a uniform height above the bath. This is advantageous, because it is easier to maintain a uniform cover of alumina (not shown) on the surfaces 30, this resulting in less airburning.

Localized, higher than normal heat and electrical loading of anodes can occur in the present invention. This may lead to cracking of the lower corners or edges of the anodes. Advantageously, this possibility of craking may be resisted by providing chamfer (not shown) on the lower corners or edges of the anodes.

Potential benefits from this invention include:

(1) Increased current efficiency.

(2) Lower energy required per pound of aluminum produced.

(3) Less carbon consumed per pound of aluminum produced.

(4) Lower fluoride emission per pound of aluminum produced.

(5) Man-hour savings.

(6) Maintenance savings.

Further illustrative of the invention is the following Example.

EXAMPLE

This Example is with reference to a Hall/Heroult cell containing a plurality of prebaked anodes. The cell operates above 100 kiloamperes and has a fixed superstructure and a bridge movable up and down on the superstructure. All anodes are clamped to the bridge, so that movement of the bridge causes all anodes to move in unison. The cell undergoes a setting of all anodes according to the present invention as follows.

First, the pot has the crust surrounding the carbon either removed from the pot or knocked into the pot to dissolve or melt. An anode effect may or may not be scheduled afterwards, an advantage of scheduling one being that it is then easier to go on anode effect in the steps which follow below.

The carbon are then set in the pot 1, 2, 3, or 4 at a time. The following procedure is used, but it is only one of many possible.

(1) Mark anode bridge position relative to the superstructure. In Step (5) below, the bridge is brought back about to this position, since it will about correspond to a 20-volt anode effect.

(2) Mark the rods of two end carbon butts with a yellow mark to show their position relative to the top of the bridge, the top of the bridge being essentially a horizontal line from one end of the cell to the other. Then, unclamp the two rods and set the two consumed anodes (comprising rods, stubs and butts) on the floor, such that the undersides of the butts rest in contact with the floor. Now, all new anodes have a black mark on their anode rods a fixed distance from the bottom of the carbon. Move a wooden gage having the length of that fixed distance alongside each of the butts on the floor, and, with one end of the gage on the floor, measure the distances between the yellow marks and the upper end of the gage for both of the anodes. Then, two new anodes are clamped to the bridge in replacement of the two end carbon butts, with the black marks of the rods above the top of the bridge by the respective distances that were measured between the yellow marks and the top of the gage. With the end anodes set, a reference line is established to set the rest of the new anodes to the approximate position of the butts being replaced. The basic idea in this procedure is to have the bottom surfaces of the new carbon anodes about where the bottom surfaces of the butts were.

(3) Proceed to set two carbon at all four corners of the cell. Then set the remainder of the pot. This may be done by setting the remainder of one side, or setting may alternate between the two sides, e.g. two anodes on one side, then two on the other side, etc.

(4) During setting, anode effect will occur, as the bath temperature decreases as more and more of the new, colder anodes are clamped in place and as current density increases at the more conductive but fewer and fewer butts. Anode effect will occur, even though the overall alumina content is high enough that anode effect would not occur in normal cell operation. Move the bridge downwards to bring the bottom surfaces of the anodes closer to, or even somewhat into contact with, the metal pad in order to control the pot voltage to less than 20 or 25 volts, e.g. 8–15 volts, to minimize potential for arcing. This is in contrast to usual anode effect voltage of about 30 volts. Reset any particular anodes that may be out of control (as indicated, e.g. by reddening of the anode rod), such as may occur from time to time due to a bad stub connection or other defect.

(5) After setting, raise anodes until pot is on an about 20 to 25 volt anode effect to introduce heat into the cell. Provided the alumina content is not so low as to cause anode effect during normal cell operation, this introduction of heat will begin to melt bath frozen on the bottoms of the anodes and increase the conductivity of the new carbon anodes. As conductivity increases, voltage will fall, the anode effect is lost, and normal cell operation returns.

(6) When pot is crusted, cover the carbon with alumina to prevent airburning.

Experience with operation according to this Example indicates the following improvements relative to the previous practice of changing only 4 to 25% of the anodes per day:

Current Efficiency Increase: 2%

KWH Per Pound Decrease: 6%

Net Carbon Consumption Decreases: 5%

Initially, when this invention was suggested, others predicted that it would so disturb cell operation that the cell would be rendered inoperable. In fact, what proves to happen is that there is a short period of disturbance followed by a long period of virtually no disturbance, as compared with the presence of some disturbance all the time under the prior practice of changing 4 to 25% of the anodes each day. The net effect of practice according to the invention is an improved operation as indicated, e.g., by the above listed improvements obtained so far in current efficiency, KWH/lb. and net carbon.

Whereas in the previous practice, it might take 10 to 12 hours before a new anode begins to carry its fair share of electrical current, in the present invention changing all the anodes at one time leads to the increased voltage of anode effect, with consequent evolution of heat, such that the anodes heat up to cell operating temperature quickly and lose sufficiently their coatings of frozen bath such that all anodes begin carrying current essentially immediately. One extra benefit is that there is very little electrical current flow out of the vertical direction. With most of the current flowing in the vertical direction, magnetic disturbance of the metal pad is reduced.

An interesting aspect of this invention is its setting of anodes during anode effect (e.g., voltage across cell is greater than 10 volts). This is contrary to conventional wisdom which teaches that setting of an anode should not be done during anode effect.

The term "anode effect" as used herein is intended to encompass a cell voltage condition greater than the normal cell operating voltage in the neighborhood of 5 volts, without limitation as to whether the higher voltage condition is being caused by the usual gas film on the bottom surfaces of the anodes. Thus, some of the higher voltage conditions arising in carrying out the present invention may be more attributable to frozen bath on the new anodes than to gas films.

While the invention has been described with reference to a cell where all anodes are clamped on one bridge spanning the entire cell, it is as well applicable to cells such as shown in U.S. Pat. No. 4,269,673 of John F. Clark on "Anode Mount," where, e.g. there may be one jack for every two anodes.

While the invention has been described in terms of preferred embodiments, the claims appended hereto are intended to encompass all embodiments which fall within the spirit of the invention.

What is claimed is:

1. In a process for producing aluminum by electrolysis of alumina dissolved in a cryolite-based molten salt contained between a cathode and a plurality of previously baked carbon anodes which are consumed with evolution of oxides of carbon, the improvement comprising replacing all anodes at the same time.

2. A process as claimed in claim 1 wherein the step of replacing is completed within 48 hours.

3. A process as claimed in claim 1 wherein the step of replacing is completed within 24 hours.

4. A process as claimed in claim 1 wherein the step of replacing is completed within about 1 hour.

5. A process as claimed in claim 1, an anode effect occurring during the replacing.

6. A process as claimed in claim 5, further comprising bringing the anodes close to or even into contact with an aluminum pad during the replacing, whereby the possibility of arcing is reduced.

7. A process as claimed in claim 6, further comprising, following completion of the replacing, backing the anodes from the pad a distance to increase voltage to permit increased evolution of heat, whereby anode effect is lost.

8. A process as claimed in claim 1, voltage across the cell rising to greater than 10 volts during the replacing.

9. A process as claimed in claim 8, further comprising controlling the voltage to less than 25 volts during the replacing.

* * * * *

UNITED STATES PATENT AND TRADEMARK OFFICE

CERTIFICATE OF CORRECTION

PATENT NO. : 4,592,813

DATED : June 3, 1986

INVENTOR(S) : George H. Henry

It is certified that error appears in the above-identified patent and that said Letters Patent is hereby corrected as shown below:

Title page:

Name of Primary Examiner: Change "Edward" to --Howard--.

Signed and Sealed this

Twenty-fourth Day of February, 1987

*Attest:*

DONALD J. QUIGG

*Attesting Officer*

*Commissioner of Patents and Trademarks*